United States Patent [19]

Denis et al.

[11] Patent Number: 4,785,386

[45] Date of Patent: Nov. 15, 1988

[54] ORIENTABLE LIGHTING APPARATUS FOR A POND CONTAINING RADIOACTIVE MATERIALS

[75] Inventors: Jean Denis, Sache; Lucien Leproust, Ivry sur Seine, both of France

[73] Assignee: Electricite De France Service National, Paris, France

[21] Appl. No.: 81,286

[22] Filed: Aug. 3, 1987

[51] Int. Cl.[4] ..... F21V 21/14

[52] U.S. Cl. ..... 362/428; 362/287; 362/267; 362/101; 376/249

[58] Field of Search ..... 362/89, 101, 269, 271, 362/272, 275,.285, 286, 287, 386, 418, 421, 428, 432, 267, 158; 376/249, 268

[56] References Cited

U.S. PATENT DOCUMENTS 4,429,350 1/1984 Guthrie ..... 362/267 X 4,482,939 11/1984 Tishman ..... 362/287 X

*Primary Examiner*—Stephen F. Husar

*Attorney, Agent, or Firm*—Pearne, Gordon, McCoy & Granger

[57] ABSTRACT

The handling pond of a pressurized water nuclear reactor is equipped with orientable lighting apparatuses. Each apparatus comprises a floating lighting means mounted at the end of an also floating articulated arm. The opposite end of the arm is supported by a vertical guide mounted on one edge or side of the pond. The lighting means comprises a floodlight emitting a parallel beam of light through the transparent bottom of a tight box, which also contains means for orienting the floodlight about two orthogonal axes. A cover, positioned out of the water, gives access to the interior of the box.

9 Claims, 3 Drawing Sheets

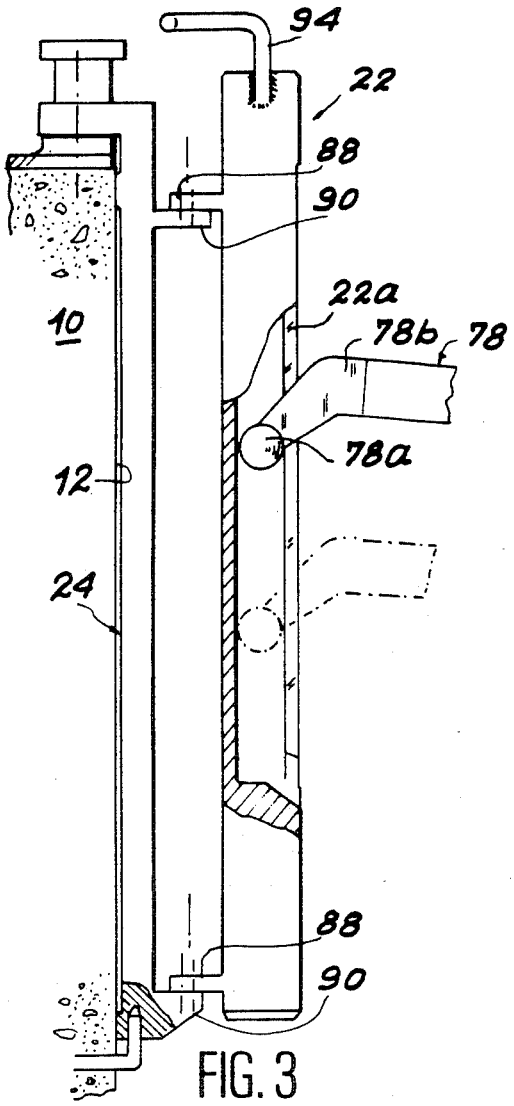
FIG. 3
FIG. 5
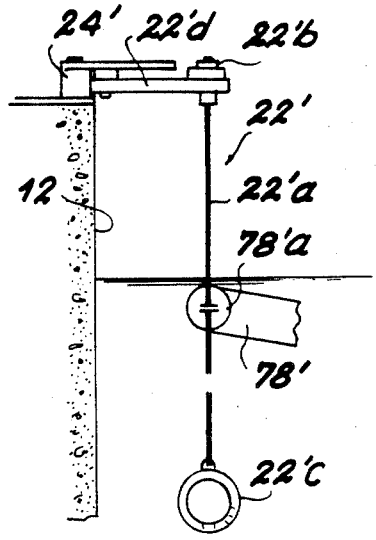
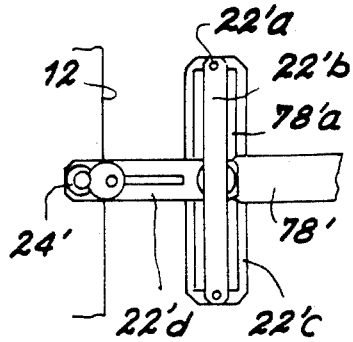
FIG. 6
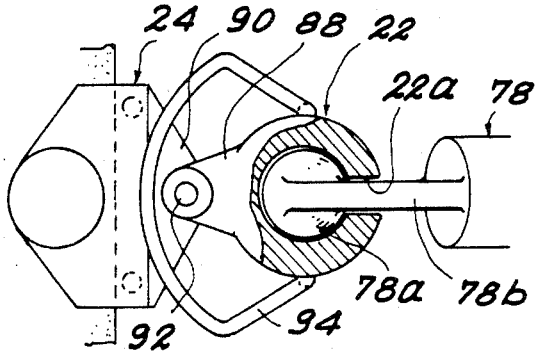
FIG. 4

ORIENTABLE LIGHTING APPARATUS FOR A POND CONTAINING RADIOACTIVE MATERIALS

BACKGROUND OF THE INVENTION

The invention relates to an orientable lighting apparatus for equipping a pond containing radioactive materials.

More specifically, the apparatus according to the invention is intended to permit the illumination of nuclear fuel assemblies during their handling under water in the pond of a pressurized water nuclear reactor. In particular, said lighting makes it possible to see at a distance the insertion of the assembly on centering pins of the lower plate of the core.

However, this application is not limitative and the orientable lighting apparatus according to the invention can be used in all cases where handling radioactive materials in a pond requires an effective lighting system. For example, the apparatus according to the invention can also equip a storage pond storing irradiated nuclear fuel assemblies prior to the reprocessing thereof.

In the present state of the art, pressurized water nuclear reactor ponds are equipped with a group of fixed floodlights distributed round the pond circumference. These floodlights are immersed and emit divergent light beams in directions which are determined once and for all.

The existing installations suffer from a certain number of disadvantages resulting both from the submerged nature of the floodlights, the fact that the said floodlights are fixed and the path taken by the beams of light emitted by them.

The disadvantages associated with the immersion of these floodlights firstly relate to the need of ensuring a complete sealing thereof. Moreover, their mass must be relatively great, which further complicates the installation thereof, which must take place by means of a travelling crane. Finally, in view of the radioactive materials contained in the pond, it is difficult to maintain said floodlights.

Furthermore, the fixed and divergent character of the beams of light emitted by these floodlights leads to diffused illumination of a relatively ineffective nature, as well as to the presence of shadows which further complicate handling.

SUMMARY OF THE INVENTION

The present invention more particularly relates to a novel pond lighting apparatus making it possible to solve these different problems through the use of a floating, orientable floodlight, which is substantially parallel to the beam of light emitted by the floodlight.

More specifically, the present invention relates to an orientable lighting apparatus for equipping a pond containing radioactive materials, wherein it comprises a vertical guide which can be mounted on one side of the pond a floating, tight box having a transparent lower partition, a floodlight contained in the box and able to emit a substantially parallel beam of light through said lower transparent partition, means contained in the box for orienting the floodlight about two axes which are orthogonal to one another and a floating arm incorporating at least two segments which are articulated to one another about a first axis perpendicular to the vertical plane containing said arm, a first end of the arm being mounted on the guide so as to be able to move in a vertical direction defined by the guide and being able to pivot about a second axis perpendicular to said plane, the box being articulated on a second end of the arm about a third axis perpendicular to said plane.

In this apparatus, the mounting of the first end of the floating arm in a guide authorizing its vertical displacement makes it possible to compensate any pond level variations. Moreover, the use of an articulated arm makes it possible to avoid the fracture or breakage of parts constituting the apparatus in the case of a shock or impact between a handling device and the lighting apparatus.

In order to facilitate the automatic bending of the articulated arm in the case of such an impact, the segments are preferably articulated so as to define a maximum angle of less than approximately 160°.

According to a preferred embodiment of the invention, an anchoring member which can be fixed to the side of the pond supports the vertical guide by means of an articulation permitting an orientation of the guide about a vertical axis.

According to another aspect of the invention security is improved through various arrangements giving the elements constituting the apparatus a non-losable character.

Thus, the box is preferably surrounded by a removable floating part constituted by a hollow, tight part filled with foam ensuring the buoyancy, even in the case of perforation of said part.

The lower transparent partition of the box is preferably provided with a glass plate coated with a plastic film on its lower face. If the glass breaks, the plastic material lining its lower face then prevents the dropping of glass fragments into the pond.

According to a preferred embodiment of the invention, the floodlight comprises a lamp located at the focal point of a parabolic mirror. The replacement of the lamp of the floodlight and in more general terms any intervention within the box can be facilitated by the presence of a detachable cover positioned above the level of the water contained in the pond and supporting the floodlight, as well as its orientation means.

BRIEF DESCRIPTION OF THE DRAWINGS

The invention is described in greater detail hereinafter relative to non-limitative embodiments and the attached drawings, wherein show:

FIG. 3 A larger scale, part sectional view showing the part of the apparatus of FIG. 1 fixed to the side of the pond.

FIG. 4 A part sectional plan view of the part of the apparatus shown in FIG. 3.

FIG. 5 A view comparable to FIG. 3 illustrating a variant of the apparatus according to the invention.

FIG. 6 A plan view of the part of the apparatus shown in FIG. 5.

DETAILED DESCRIPTION OF THE PREFERRED EMBODIMENTS

Figure 1:
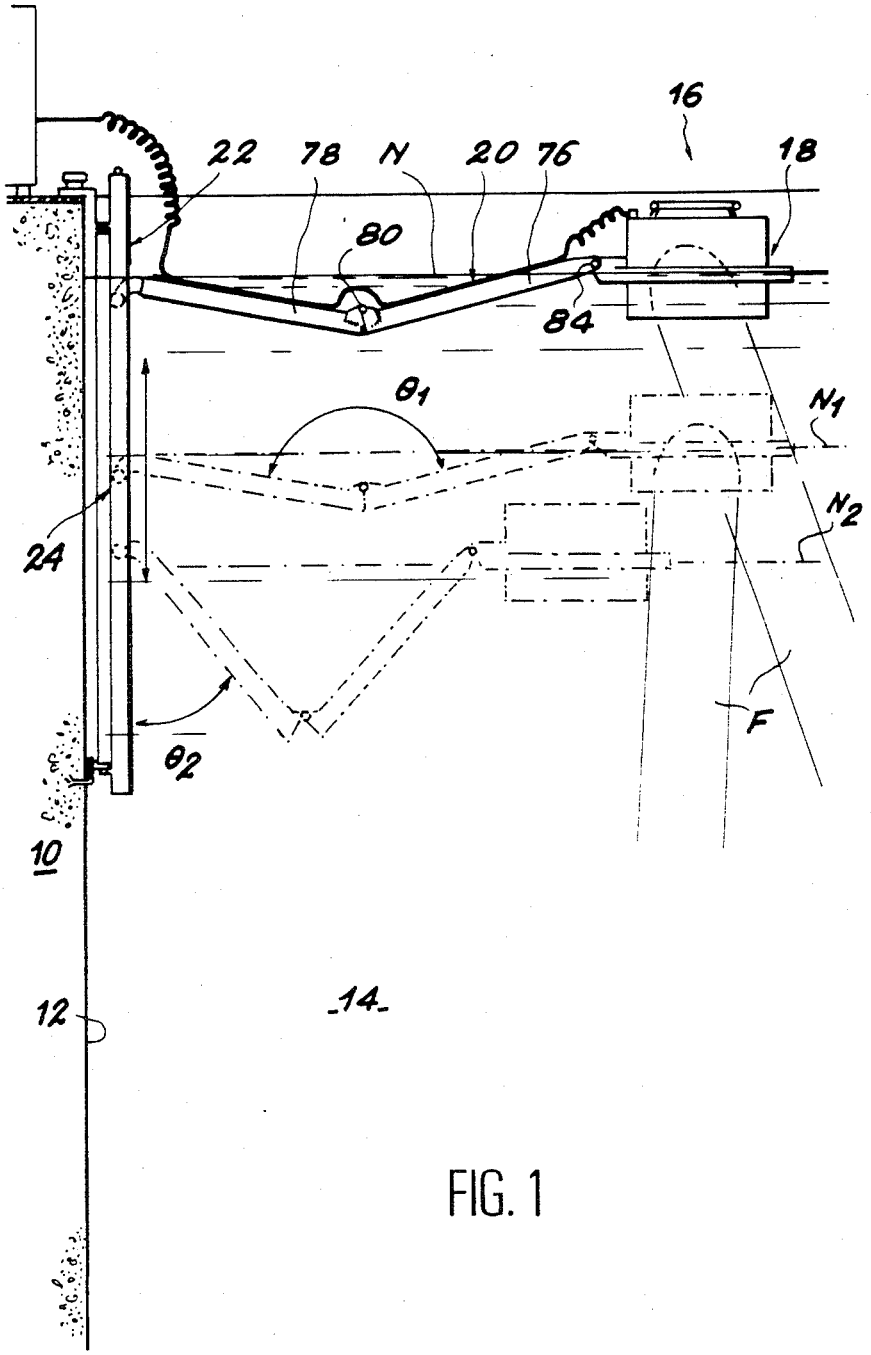
FIG. 1 A diagrammatic, part sectional side view illustrating the installation of an orientable lighting apparatus according to a first embodiment of the invention in a pond for handling assemblies of a pressurized water nuclear reactor.

FIG. 1 shows part of a handling pond of a pressurized water nuclear reactor. More specifically, FIG. 1 shows in sectional form a wall 10 defining one of the edges or sides 12 of the pond filled with water 14 up to level N.

According to the invention, this pond is equipped with several orientable lighting apparatuses, such as apparatus 16 in FIG. 1. In practice, a pressurized water reactor handling pond will e.g. be equipped with three apparatuses of this type.

As is very diagrammatically illustrated in FIG. 1, each of the orientable lighting apparatuses 16 comprises a floating lighting means 18 mounted at one end of an articulated arm 20, the opposite end of said arm 20 being mounted on a guide 22 supported by an anchoring part 24 fixed to the side 12 of the pond.

The lighting means 18 will now be described in greater detail relative to FIG. 2. Means 18 comprises a tight box 26 in which are located a floodlight 23 and its orientation means 25. Box 26 comprises a vertically axed cylindrical wall 27 and a lower wall essentially comprising a horizontal glass plate 28 permitting the passage of light rays. Plate 28 is tightly fixed to wall 27 by means of a fixing flange 30 which compresses a gasket 31.

In order to prevent glass fragments dropping into the pool in the hypothesis of plate 28 breaking, the lower face of said plate is coated with a plastic material film 32. At its upper end, box 26 is closed by a detachable horizontal cover 34 maintained in place on the end of wall 27 of the box by a threaded ring 36 compressing a gasket 37.

The buoyancy of means 26 is obtained by a float detachably fixed to box 26. This float is constituted by a hollow annular part 38 surrounding or encircling the box 26 approximately at mid-height and on which the latter rests by a ring or by a certain number of clips 40 distributed around the circumference of wall 27. Box 27 is dismantlably fixed to the floating part 38 by bolts 42.

Part 38 is a hollow sheet metal part having in cross-section an approximately rectangular shape. Part 38 is filled with floating foam 44. Thus, the floating character of means 18 is ensured even in the case where part 38 is perforated as a result an impact during handling.

According to an important aspect of the invention, a floodlight 23 emitting a high power light beam (e.g. approximately 8,000,000 Candelas) and of a substantially parallel nature is located within box 26.

In practice, floodlight 23 comprises a lamp 46, such as an are lamp, located at the focal point of a parabolic mirror 48. It is the assembly constituted by lamp 46 and parabolic mirror 48 which gives the floodlight a power of 8,000,000 Candelas. The assembly is placed in box 26, so as to emit a parallel light beam F (FIG. 1) generally oriented downwards through the glass plate 28.

Moreover, according to another important aspect of the invention, the floodlight 23 constituted by lamp 46 and parabolic mirror 48 is located within box 26, so that it can be oriented, as desired, about two orthogonal axes. In FIG. 2, these axes are respectively designated by references xx' and yy'.

In practice, the mounting of the floodlight in box 26 is effected in the following way. A support 50, fixed to the box cover 34 supports both a first geared motor 52 and a ring 54 surrounding the peripheral edge of mirror 48. More specifically, ring 54 is pivotably received on support 50 by means of two pivots having a horizontal axis xx'.

The output shaft of geared motor 52, whose axis is parallel to axis xx' carries a cam on which is articulated one end of a rod 56. The opposite end of rod 56 is articulated to a lever 58, whose other end is fixed to ring 54 in the vicinity of axis xx'.

As a result of these characteristics, the actuation of geared motor 52 has the effect of rotating ring 54 about axis xx'. Ring 54 pivotably supports the ends of a fork 60 disposed outside mirror 48, according to one of the planes of synmetry thereof. The pivotable mounting of fork 60 on ring 54 is obtained by two pivots with a geometrical axis yy' perpendicular to horizontal axis xx'. The central part of fork 60 supports mirror 48 and the socket for holder 47 of lamp 46.

The orientation of floodlight 23 about axis yy' is controlled by means comparable to those controlling the orientation of ring 54 (and consequently the floodlight 23 supported by the latter about axis xx'). These means comprise a second geared motor 62 mounted on a support 64 fixed to ring 54. The output shaft of geared motor 62, whose axis is parallel to axis yy' drives by means of a cam 65 one end of a rod 66, whose opposite end is articulated to a lever 68 integral with fork 60 by its other end located in the vicinity of axis yy'.

As a result of the structure described hereinbefore, the control of geared motors 52, 62 makes it possible to orient, as required, the floodlight 23 consituted by lamp 46 and mirror 48 about two orthogonal axes xx' and yy' within box 26.

The travel of the mirror is limited by end of travel abutments equipped with electric microcontacts. Thus, impacts which might damage the mirror are avoided.

Moreover, the assembly is supported by box cover 34, so that the dismantling of said cover, which is permanently emerged, permits an easy intervention within box 26, more particularly for the replacement of lamp 46.

In order to control the energizing of lamp 46, its extinction and the control of the orientation movements with the aid of motors 52 and 62, there are two possible options. A first so-called manual control takes place by means of a power supply cable 70 passing through box cover 34. These different controls can also take place remotely with the aid of an infrared remote control means.

Figure 2:
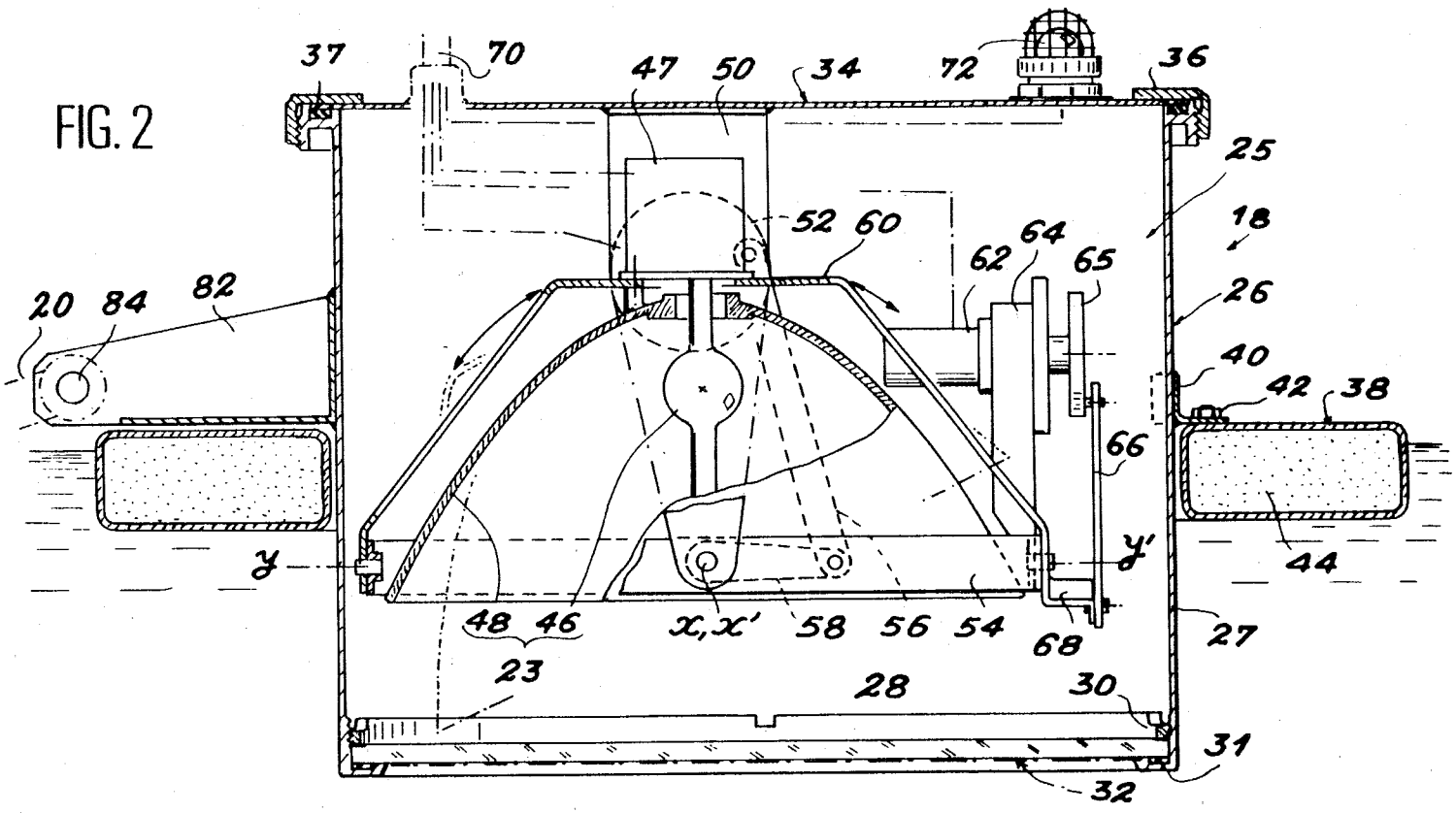
FIG. 2 A vertical sectional view showing on a larger scale the lighting means of the apparatus of FIG. 1.

Preferably and as illustrated in FIG. 2, a light indicator 72 placed on box cover 34 makes it possible to check the operation of the floodlight. In order to facilitate its handling, box 26 of the lighting assembly can be equipped with handles 74 (FIG. 1).

On its cylindrical wall 27 and above float 38, the box 26 also has an anchoring part 82, whereof one end is articulated by a horizontal pin 84 on one of the ends of arm 20.

On referring to FIG. 1, it can be seen that articulated arm 20 comprises two segments 76, 78 of equal length, said segments being articulated to one another by a horizontal pin 80 parallel to pin 84 by means of which the lighting means 18 is articulated to segment 76. The opposite end of segment 78 is also slidingly articulated on guide 22, in a way which permits a pivoting of segment 78 about an axis parallel to pins 80 and 84. These three pivoting axes are perpendicular to a vertical plane containing the two segments of arm 20.

According to an essential feature of the invention, arm 20 also floats. This is obtained by making segments 76 and 78 from sheet steel in order to give them a hollow structure.

For a reason which will become apparent hereinafter, at their common articulation pin 80, each of the two segments 76 and 78 has an abutment limiting the angle $\theta_1$ formed between these segments to a maximum value of approximately 160°. Thus, the two segments 76, 78 permanently form an open V corresponding to their equilibrium position resulting from the pressure of the water. This position is shown in continuous line form in FIG. 1

In the case where the control of the power supply of lamp 46 and motors 52, 62 of lighting means 18 takes place by a cable 70, the latter is fixed to each of the segments 76, 78 of arm 20 in the manner illustrated in FIG. 1. The opposite end of cable 70 is connected to an appropriate control means 86. The anchoring of apparatus 16 to the side 12 of the pond will now be described in greater detail with reference to FIGS. 3 and 4. In the latter it is possible to see the end of segment 78 received in guide 22 and comprising a ball and socket joint 78*a* located at the end of a flat portion 78*b* located in the vertical plane containing arm 20.

Guide 22 is essentially constituted by a vertically axed cylindrical tube within which is received the ball and socket joint 78*a*. Over most of its height, tube 22 has a slot 22*a* extending vertically along a generatrix and through which passes the flat portion 78*b* of segment 78.

Moreover, the downward deflection of segment 78 permitted by ball and socket joint 78*a* is not limited. In other words, the angle $\theta_2$ (FIG. 1) formed between the segment 78 and the vertical axis of guide tube 22 can assume a random value.

At diametrically opposite locations with respect to slot 22*a*, guide tube 22 carries two lugs 88, by which it is pivotably supported on anchoring piece 24 fixed to the edge 12 of the pond.

More specifically, anchoring piece 24 has two lugs 90 on which rest the lugs 88 of guide tube 22, said lugs being traversed by pins 92 permitting a pivoting of guide tube 22 about a vertical axis with respect to the anchoring part 90.

The latter is itself fixed by any appropriate means to the pond side 12, so as to support the orientable lighting apparatus 16. Finally, at its upper emerged end guide tube 22 has a handling handle 94.

Bearing in mind the floating nature of the lighting means 18 and the articulated arm 20, said two elements normally occupy the position represented in continuous line form in FIG. 1 when the water level 14 corresponds to level N.

In view of the fact that ball and socket joint 78*a* can be freely displaced in guide tube 22, if a variation occurs in the level of the water contained in the pond, the lighting means 18 and articulated arm 20 follow said variation, whilst remaining in the same relative position. This feature is illustrated in mixed line form in FIG. 1, in the case where the level of water 14 has dropped to a level N1.

Thus, no matter what the water level within the handling pond, it is possible to selectively illuminate in high power manner that part thereof in which handling takes place, by effecting a random orientation of the floodlight by actuating the corresponding geared motors.

Moreover, if an impact occurs between the handling means and lighting means 18, apparatus 16 according to the invention is designed in such a way as to automatically give way.

Thus, under the effect of the component of such a shock oriented horizontally towards edge 12 in the vertical plane containing arm 20, the latter automatically bends back in the manner indicated in mixed line form at the bottom of FIG. 1, in the case where the water level in the pond has a value N2. It should be noted that the bending back of arm 20 is permitted in this case by the existence of an initial angle $\theta_1$ of approximately 160° between the two segments of articulated arm 20.

The articulated arm automatically reassumes its initial extended position under the effect of the pressure of the water exerted on segments 76, 78 of the arm. This automatic reextension is facilitated by the existence of waves on the surface of the pond.

When the impact between the handling means and the lighting means 18 comprises a horizontal component perpendicular to the vertical plane containing arm 20, the torque exerted in this way on means 18, arm 20 and guide 22 leads to the pivoting of the latter about the vertical axis defined by axes 92. The apparatus is then automatically brought into its working position by acting on handle 94.

FIGS. 5 and 6 show a variant of guide 22, in this case designated by reference 22'. In this variant, the rigid tube is replaced by a flexible cable 22'*a*, whose two ends are suspended on the ends of a horizontal arm 22'*b* parallel to the edge 12 of the pond. The cable passes through two hooks formed at the ends of a counterweight 22'*c*, whose length is approximately the same as that of arm 22'*b*. This counterweight 22'*c* ensures the tension of two vertical strands of cable 22'*a*, on which slide two hooks mounted at the ends of a cylindrical, horizontally axed portion 78'*a*, formed at the end of segment 78' of arm 20.

Arm 22'*b* is itself fixed to the end of a horizontal part 22'*b* oriented perpendicularly to the edge 12 of the pond. The other end of part 22'*b* is dismantlably fixed to support 24' mounted on the pond edge.

This variant of FIGS. 5 and 6 ensures an operation identical to that of the previously described embodiment with reference to FIGS. 3 and 4.

In particular, any variation in the water level is compensated by a sliding of portion 78'*a* of the segment along the vertical strands of cable 22'*a*.

Moreover, the guidance of said portion 78'*a* by the cable strands permits the bending back of the articulated arm and its pivoting about a vertical axis intermediate between these strands, under the effect of a horizontal shock on the lighting means 18. The return of the articulated arm to its equilibrium position then takes place automatically, under the effect of the tension of cable 22'*a* ensured by counterweight 22'*c*.

Apart from the advantages resulting from the use of a floodlight emitting a powerful, substantially parallel beam of light and the orientable nature of said beam, the apparatus according to the invention also offers numerous advantages as a result of its buoyancy.

Thus, the sealing problems are limited to the lower part of box 26 and more specifically to the fixture of the glass plate 28 to the lower portion of wall 27.

Moreover, most of the parts subject to wear are not submerged in the pond water, so that maintenance is facilitated. addition, the apparatus has a relatively light weight and can be manipulated by one person without the aid of a travelling crane.

Finally, it should be noted that security is maintained through the absence of any part which can be lost, a breaking of the glass plate 28 having no effect as a result of the presence of the plastic material film 32 on the lower face of said plate.

Obviously, the orientable lighting apparatus according to the invention can undergo various modifications without passing beyond the scope of the invention. For example, the articulated arm can be constituted by three segments, particularly in the case where the distance between the edge of the pond and the installation point of the lighting means is very great. The floating nature of the lighting means box can also result from the box itself and not an annular part surrounding the latter.

What is claimed is:

1. An orientable lighting apparatus for equipping a pond containing radioactive materials, wherein it comprises a vertical guide which can be mounted on one side of the pond, a floating, tight box having a transparent lower partition, a floodlight contained in the box and able to emit a substantially parallel beam of light through said lower transparent partition, means contained in the box for orienting the floodlight about two axes which are orthogonal to one another and a floating arm incorporating at least two segments which are articulated to one another about a first axis perpendicular to the vertical plane containing said arm, a first end of the arm being mounted on the guide so as to be able to move in a vertical direction defined by the guide and being able to pivot about a second axis perpendicular to said plane, the box being articulated on a second end of the arm about a third axis perpendicular to said plane.

2. An apparatus according to claim 1, wherein the segments are articulated to one another so as to define an angle ($\theta_1$) limited to a maximum value of approximately 160°.

3. An apparatus according to claim 1, wherein an anchoring part which can be fixed to the edge of the pond supports the vertical guide by means of an articulation authorizing an orientation of the guide about a vertical axis.

4. An apparatus according to claim 1, wherein a detachable floating part encircles the box.

5. An apparatus according to claim 4, wherein the detachable floating-part is a hollow, tight part, which is filled with floating foam.

6. An apparatus according to claim 1, wherein the box comprises a detachable cover located above the level of the pond.

7. An apparatus according to claim 6, wherein the floodlight and its orientation means are fixed to the cover.

8. An apparatus according to claim 1, wherein the lower transparent partition of the box comprises a glass plate coated with a plastic material film on its lower face.

9. An apparatus according to claim 1, wherein the floodlight comprises a lamp located at the focal point of a parabolic mirror.

* * * * *